US006753490B2

(12) United States Patent
Svetlik et al.

(10) Patent No.: US 6,753,490 B2
(45) Date of Patent: Jun. 22, 2004

(54) AMBIDEXTROUS SWITCH LOCKOUT SYSTEM

(75) Inventors: Kenneth Svetlik, Schaumburg, IL (US); Peter Domeny, Northbrook, IL (US)

(73) Assignee: S-B Power Tool Corporation, Broadview, IL (US)

( * ) Notice: Subject to any disclaimer, the term of this patent is extended or adjusted under 35 U.S.C. 154(b) by 0 days.

(21) Appl. No.: 10/271,895

(22) Filed: Oct. 16, 2002

(65) Prior Publication Data

US 2004/0074752 A1 Apr. 22, 2004

(51) Int. Cl.[7] ..... H01H 1/52; H01H 3/20; H01H 9/00

(52) U.S. Cl. ..... 200/321; 200/318; 200/518; 200/43.16

(58) Field of Search ..... 200/321, 318, 200/322, 333.1, 320, 518, 43.16, 43.17, 43.18, 318.1

(56) References Cited

U.S. PATENT DOCUMENTS

| | | | | |
|---|---|---|---|---|
| 2,483,727 A | | 10/1949 | Frisbie | |
| 3,737,604 A | * | 6/1973 | Dietrich et al. | 200/518 |
| 4,900,881 A | | 2/1990 | Fischer | |
| 5,005,295 A | | 4/1991 | Fushiya | |
| 5,577,600 A | * | 11/1996 | Schoene et al. | 200/43.17 |
| 5,638,945 A | | 6/1997 | Fukinuki | |
| 5,969,312 A | * | 10/1999 | Svetlik et al. | 200/61.85 |
| 6,057,518 A | | 5/2000 | Bascom | |
| 6,091,035 A | * | 7/2000 | Campbell et al. | 200/321 |
| 6,153,838 A | * | 11/2000 | Wadge | 200/50.01 |
| 6,288,350 B1 | | 9/2001 | Campbell | |
| 6,340,802 B1 | | 1/2002 | Bascom | |
| 2002/0056618 A1 | | 5/2002 | Bascom et al. | |

* cited by examiner

*Primary Examiner*—Anh Mai
*Assistant Examiner*—K. Lee
(74) *Attorney, Agent, or Firm*—Gardner Carton & Douglas LLP

(57) ABSTRACT

The present invention is for an ambidextrous lockout switch system for use with a power tool. With the system of the present invention in place, a multi-step process must be carried out before the power tool can be activated. The system is adapted for the process to be carried out with either a left or a right hand. The present invention includes a handle body having a switch trigger or lever blockable by a barrier. The barrier is movable with either a left of a right lockout button, with the right lockout button being operably linked to the left lockout button. The system includes also a spring, which is mechanically coupled to the barrier. The spring effectively restores the barrier to a position in which the barrier blocks actuation of the switch trigger or lever.

19 Claims, 8 Drawing Sheets

AMBIDEXTROUS SWITCH LOCKOUT SYSTEM

FIELD OF THE INVENTION

This invention generally relates to safety lockout switches, and more particularly, to an ambidextrous switch lockout system.

BACKGROUND OF THE INVENTION

Some power saws, such as miter saws, have safety lockout buttons that require actuation before a power switch can be turned to the on position. Safety lockout buttons effectively minimize the probability of accidental tool activation by requiring the user to follow a sequence of at least two steps before activation.

Conventional lockout buttons are spring-loaded and include an internal blocking feature that mechanically interferes with the travel of a power switch trigger or lever. After the power switch is released to an off position, the system resets, and again requires at least two steps before the tool can be activated again.

Some conventional safety lockout systems include a removable button with a hole for receiving the button. When the removable button is not in place in the hole, the tool cannot be powered up. The removable button is intended to decrease the probability for accidental tool activation by adding an additional step to the process used for activating the tool. However, the removable button is an inconvenience if lost. A lost removable button can be more than an inconvenience, and may present a safety problem, for example, if users force other items into the hole to replace the lost removable button.

Power saws with vertical handles may also have a lockout button protruding from a left side of the handle, near the switch trigger. This conventional system is not ambidextrous. When used with a right hand, the lockout button is actuated by a thumb and the switch trigger by an index finger. When used with a left hand, the lockout button and switch trigger are usually both actuated by an index finger of the left hand.

The invention disclosed by U.S. Pat. No. 5,969,312 to Svetlik et al. ("the '312 patent") is for an ambidextrous lockout switch. Although the lockout switch of the '312 patent can be operated by both a left handed user and a right handed user, and is in this sense "ambidextrous", the method for using the ambidextrous lockout switch of the '312 patent is substantially different for a right handed user than for a left handed user, and is not truly ambidextrous in this sense. In particular, a left handed user must rely on a "slide switch 22", whereas a right handed user activates a "pressure button 23" for actuation.

There is, therefore, a need in the art for a switch lockout system that is convenient for use by both left and right handed users, and is actuatable in a substantially similar way by both left and right handed users.

BRIEF SUMMARY OF THE INVENTION

The present invention provides a generally balanced ambidextrous switch lockout system, actuatable in the same way by both left handed and right handed users. On a horizontally oriented handle, left handed and right handed users perform substantially the same steps to activate the power. The left side lockout button is identical to the right side lockout button in appearance and function. In the system of the present invention, both the left handed and right handed users press the right and left lockout buttons, respectively, with a thumb. The system of the present invention resets automatically after a switch lever or trigger is released. The system of the present invention may be added to a multi-position handle, which can be selectively oriented in a plurality of positions, including both horizontal and vertical positions. The present invention is ambidextrous, i.e., suitable for use by both left handed and right handed users, in any of the plurality of positions.

In a first embodiment, the present invention generally includes: a left lockout button, a right lockout button, a linkage, a centering spring, and a switch lever. The left lockout button is pivotally mounted to the left side of a horizontal handle with a protrusion from the left side of the handle. The protrusion on the left side of the handle is intended for thumb actuation by the right hand of a user when the handle is in a generally horizontal position. On a rotatable handle, when the handle is in a generally vertical position, the left lockout button is on top, and the one left lockout button may be activated by either a left handed user or a right handed user in substantially the same way. The left lockout button includes a barrier intended to stop actuation of the switch lever. The left lockout button has an aperture spaced apart from where the left lockout button is pivotally mounted. The aperture allows for a hinged connection to the linkage between the left lockout button and the right lockout button. The left lockout button also has two fingers that contact opposite ends of a centering spring.

The right lockout button is substantially a mirror image of the left lockout button, but without the barrier or the two fingers for contacting a centering spring. The thumb of the left hand of a user presses a protrusion from the right side of the handle. The right lockout button also has an aperture for mechanical coupling (through the linkage) between the left lockout button and the right lockout button. With both left and right lockout buttons mounted to the handle and the linkage connecting them, pressing the left lockout button causes the protrusion of the right lockout button to move leftwardly, and pressing the right lockout button causes the protrusion of the left lockout button to move rightwardly.

The centering spring is mounted to the handle in a spring mount, which holds a first and a second end of the spring. The spring mount is under the left lockout button, and has left and right ends, with interruptions in both left and right ends to allow the two fingers of the left lockout button to penetrate as the left lockout button moves. Pressing on the left lockout button causes the right finger to compress the centering spring to the left. Because of the linkage, pressing down on the right lockout button causes the left finger to compress the centering spring to the right. When neither the left lockout button nor the right lockout button has been pressed, both are held by the centering spring at a blocking position. At the blocking position, the barrier of the left lockout button blocks movement of the switch lever, preventing actuation of the switch lever. When the left lockout button is pressed, the barrier moves leftwardly, outside the switch lever, and allows the switch lever to be actuated. When the operably linked right lockout button is pressed, the barrier of the left lockout button moves rightwardly, inside the switch lever, and allows the switch lever to be actuated by an inward movement.

In a first embodiment, the present invention includes an ambidextrous lockout switch including a handle body with a first side and a second side, a switch, a barrier, a first lockout button, a second lockout button, and a spring. The switch is mounted to the handle body, and extends outwardly from the handle body. The switch can be actuated by an activating movement, which might be an inward, squeezing movement The barrier is mounted inside the handle body, and is movable from a blocking position in which the activating movement of the switch is blocked. The first lockout button is movably mounted to the handle body, and is adapted for moving the barrier in and out of the blocking position. Operably linked to the first lockout button is the second lockout button, with the second lockout button also adapted for moving the barrier in and out of the blocking position. The spring, which is mounted inside the handle body, is mechanically coupled to the barrier, and biases the barrier toward the blocking position when the barrier has been moved away from the blocking position by either the left lockout button or the right lockout button.

Optionally, the barrier and the switch may have complementary surfaces, which are shaped to maximize surface contact between the barrier and the switch when the barrier is in the blocking position. The switch may have a generally conical surface, with the barrier having a generally inverted conical surface. The barrier will generally return back into the blocking position after a small movement away from the blocking position because of the complementary surfaces.

In another embodiment, the first lockout button is pivotably movable around a pivot mount near the first side of the handle body. In some embodiments, the barrier may be fixed to the first lockout button so that a pivotal movement of the first lockout button results in a movement of the barrier away from the blocking position.

In other embodiments, the second lockout button may also be pivotably movable around a pivot mount near the second side of the handle body. In such embodiments, the barrier may also be movable away from the blocking position by pivoting of the second lockout button, since the second lockout button and the first lockout button are operably linked. Optionally, the operable link between the first lockout button and the second lockout button may be a linkage.

Optionally, in some embodiments, the first lockout button may have at least one finger extending outwardly, adapted for contacting the spring. When the barrier (mechanically coupled to the first lockout button) is moved away from the blocking position, the finger of the first lockout button is effective for compressing the spring.

As will be recognized by those of skill in the art, in many embodiments, it is convenient to refer to "the first side and the second side" as "the left side and the right side", although it is not necessary to the present invention that the first side and the second side be assigned to a particular direction or handedness. For example, the first side might also be called the "right side" and the second side might be called the "left side." The first side could be called "the top side" and the second side might be called "the bottom side." All that is required for the present invention is a handle body with both a first side and a second side.

In another embodiment, the present invention is also directed to an ambidextrous switch lockout system. The system is for use with a handle body with a first side and a second side, and the system includes a switch, a first lockout button having a protrusion and a barrier, a second lockout button having a protrusion, and a spring. The switch is mounted to the handle body, extends outwardly from the handle body, and is actuatable by an activating movement, which might be an inward, squeezing movement when the switch is a switch trigger or lever.

In such an ambidextrous switch lockout system, the first and second lockout buttons are pivotably mounted to the handle body. The protrusion of the first lockout button protrudes from the first side of the handle body, and the protrusion of the second lockout button protrudes from the second side of the handle body. The barrier of the first lockout button is adapted to prevent the activating movement of the switch (and hence, the actuation of the switch), by physically blocking the activating movement when the barrier is in a blocking position. The barrier is, however, movable from the blocking position by pressing of both the first lockout button and the second lockout button. When pressed, the first lockout button pivots the barrier away from the blocking position in a first direction, and the second lockout button pivots the barrier away from the blocking position in a second direction. The second lockout button and the first lockout button may also be operably linked, so that the movement of the second lockout button results in movement of the barrier, which, in an embodiment, is part of the first lockout button. As will be recognized by those of skill in the art, in other embodiments, the barrier may be part of the second lockout button. In any embodiment, the spring mounted to the handle body is mechanically coupled to the barrier, so that the barrier is biased toward the blocking position.

As described in connection with another embodiment of the present invention, the barrier and the switch may optionally have complementary surfaces shaped to maximize surface contact between the barrier and the switch when the barrier is in the blocking position.

The first lockout button may, in some embodiments, also include at least one finger extending outwardly for contacting the spring. When the first lockout button is moved, the finger compresses the spring. Since the barrier is connected with the first lockout button, the spring is capable of moving the barrier toward the blocking position.

In another embodiment, the blocking position is associated with a defined starting angle for the first lockout button. Pressing the protrusion from the first lockout button pivots the first lockout button away from the starting angle in either a first direction or a second direction. When the first lockout button is within a first angle in the first direction or a second angle in the second direction, the activating movement of the switch is prevented. However, when the first lockout button is moved beyond the first angle in the first direction away from the starting angle or the second angle in the second direction away from the starting angle, the activating movement of the switch becomes possible. In such an embodiment, the spring is effective for restoring the first lockout button to the starting angle, where the spring is in a minimally compressed state.

As will be recognized by those of ordinary skill in the art, it is not necessary to the present invention that the first lockout button or the second lockout button be pivotally mounted to the handle body. In other embodiments of the present invention, the first lockout button or the second lockout button may be slidably mounted to the handle body. In such embodiments, the blocking position of the barrier may not be defined by a starting angle, since the barrier need not move pivotally in every embodiment. In another embodiment, the blocking position may be defined with reference to another portion of the device. All that is necessary to the invention is that the barrier block the activating movement of the switch In yet another embodiment, the present invention provides an ambidextrous lockout switch system for use in a handle body including a switch, a means for blocking, at least two means for selectively moving the means for blocking, and a means for biasing. The switch is generally actuatable by an activating movement. The means for blocking is used to block the activating movement when the means for blocking is in a blocking position. The means for biasing provides a force for restoring the means for blocking to the blocking position.

In some embodiments, the at least two means for selectively moving are a first lockout button and a second lockout button, the first lockout button and the second lockout button being operably linked. Optionally, the second lockout button may be operably linked to the first lockout button by a linkage. Also optional (as explained above) is an embodiment in which the first lockout button is pivotably mounted to a first side of the handle body and the second lockout button is pivotably mounted to a second side of the handle body. The means for blocking may be fixed to either the first or the second lockout button, so that the means for blocking is movable away from the blocking position with either the first lockout button or the second lockout button. In some optional embodiments, at least one finger may extend outwardly toward the means for biasing from one of the at least two means for selectively moving. In such an embodiment, the at least one finger is adapted for contacting the means for biasing. Finally, the means for biasing may be a spring mounted inside the handle body and mechanically coupled to the at least two means for selectively moving. Other means for biasing, such as an plastic flap or rubber band are possible.

BRIEF DESCRIPTION OF THE DRAWINGS

The foregoing and other objects, advantages, and features of the present invention will be apparent from the following detailed description and the accompanying drawings, in which.

DETAILED DESCRIPTION OF THE INVENTION

Power tools, such as miter saws, may optionally include a selectively rotatable handle, for orienting the body of the handle horizontally, vertically, or intermediately between a horizontal position and a vertical position. In some orientations of the handle body, the mechanism for activating the tool may not be convenient for use with either a left hand or a right hand. The ambidextrous lockout switch system of the present invention advantageously allows for a user of a tool incorporating the system to activate the tool with either a left hand or a right hand in substantially the same way, even as the handle body is oriented in a plurality of different positions.

Figure 1:
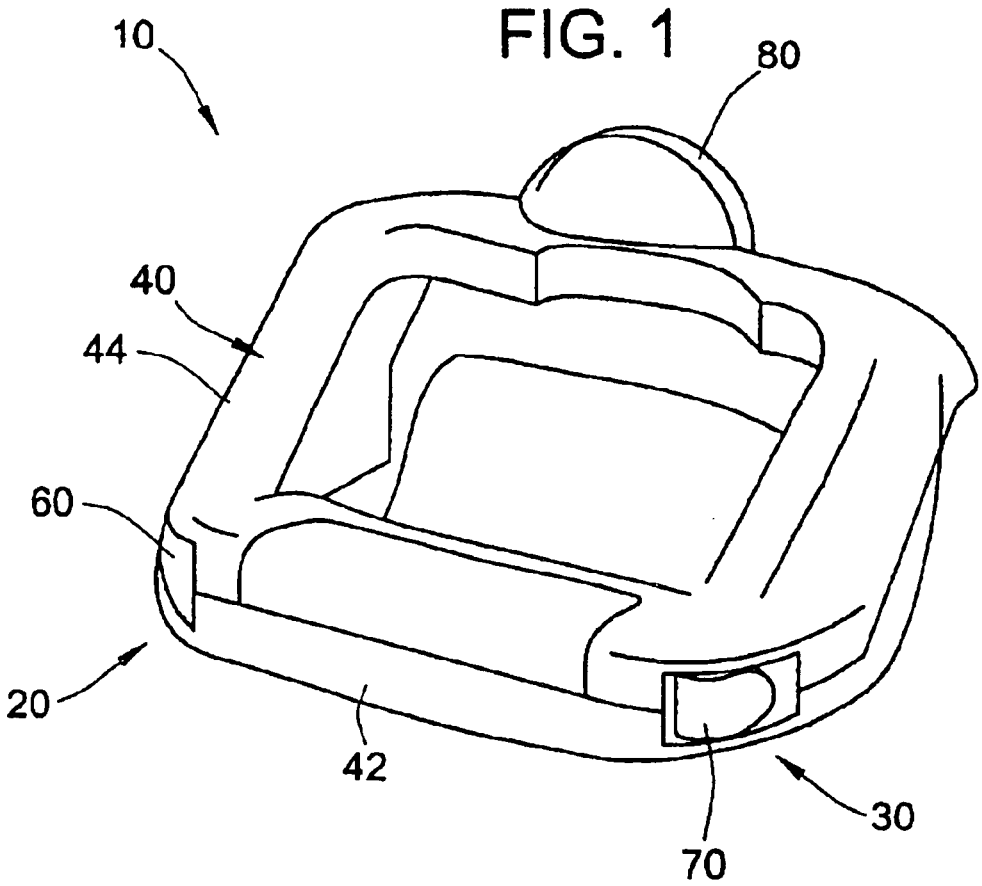
FIG. 1 is a perspective view of an ambidextrous lockout switch, in accordance with an embodiment of the present invention.

A perspective view of an embodiment of an ambidextrous switch lockout system 10 for a power tool, in accordance with the present invention, is shown in FIG. 1. The handle body 40 includes a handle bottom 42, a handle top 44, and a collar mount 80. Protruding from a left side 20 and a right side 30 of the handle body 40 are a left lockout button 60 and a right lockout button 70.

Figure 2:
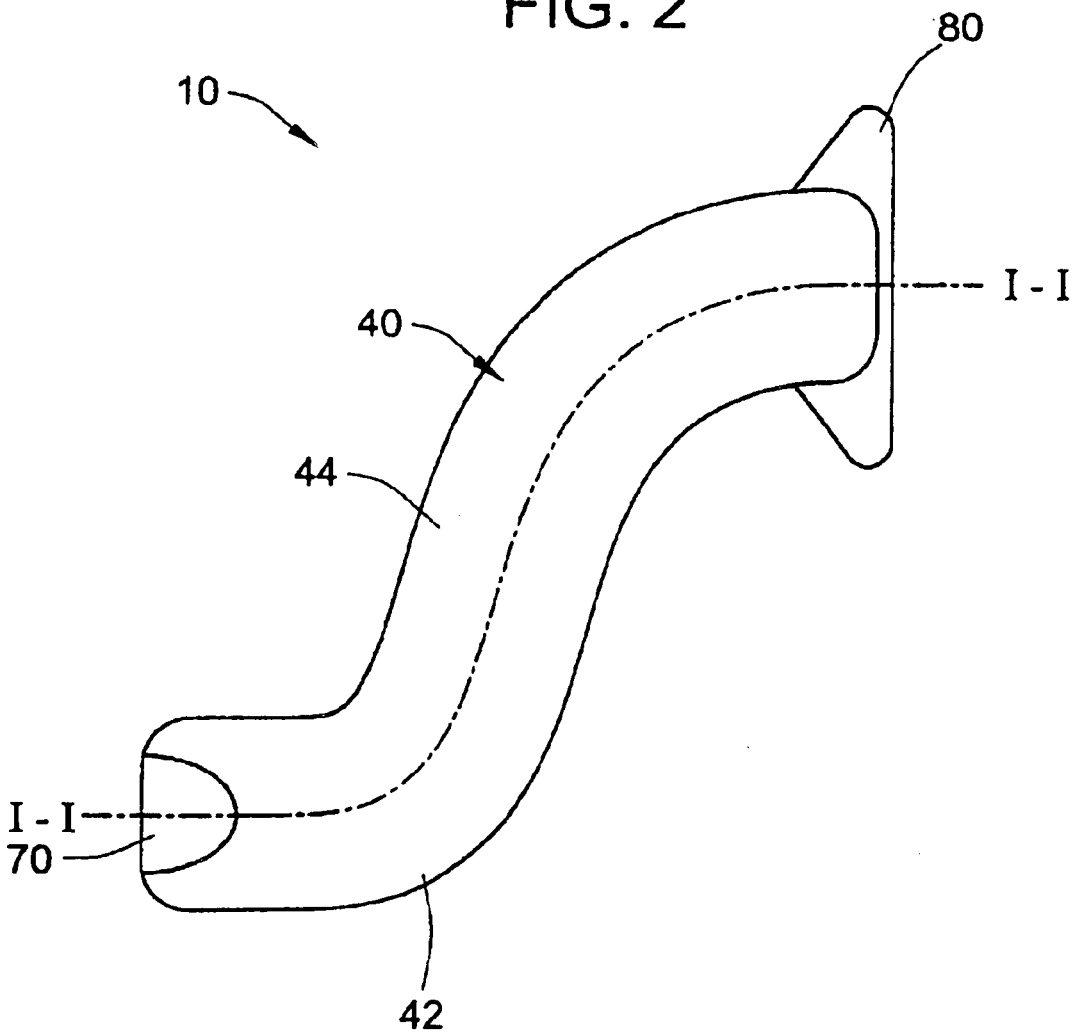
FIG. 2 is a side elevation view of an ambidextrous lockout switch, in accordance with an embodiment of the present invention.

In an embodiment, the handle body 40 of the present invention has a bi-level shape. A side-elevation view of the handle 10 from the right is shown in FIG. 2. A cross-sectional plane extending into the plane of the page is shown bisecting the handle body 40 generally along a line I—I in FIG. 2. Since the side view is from the right, the right lockout button 70 is visible, along with the handle bottom 42, the handle top 44, and the collar mount 80.

Figure 3:
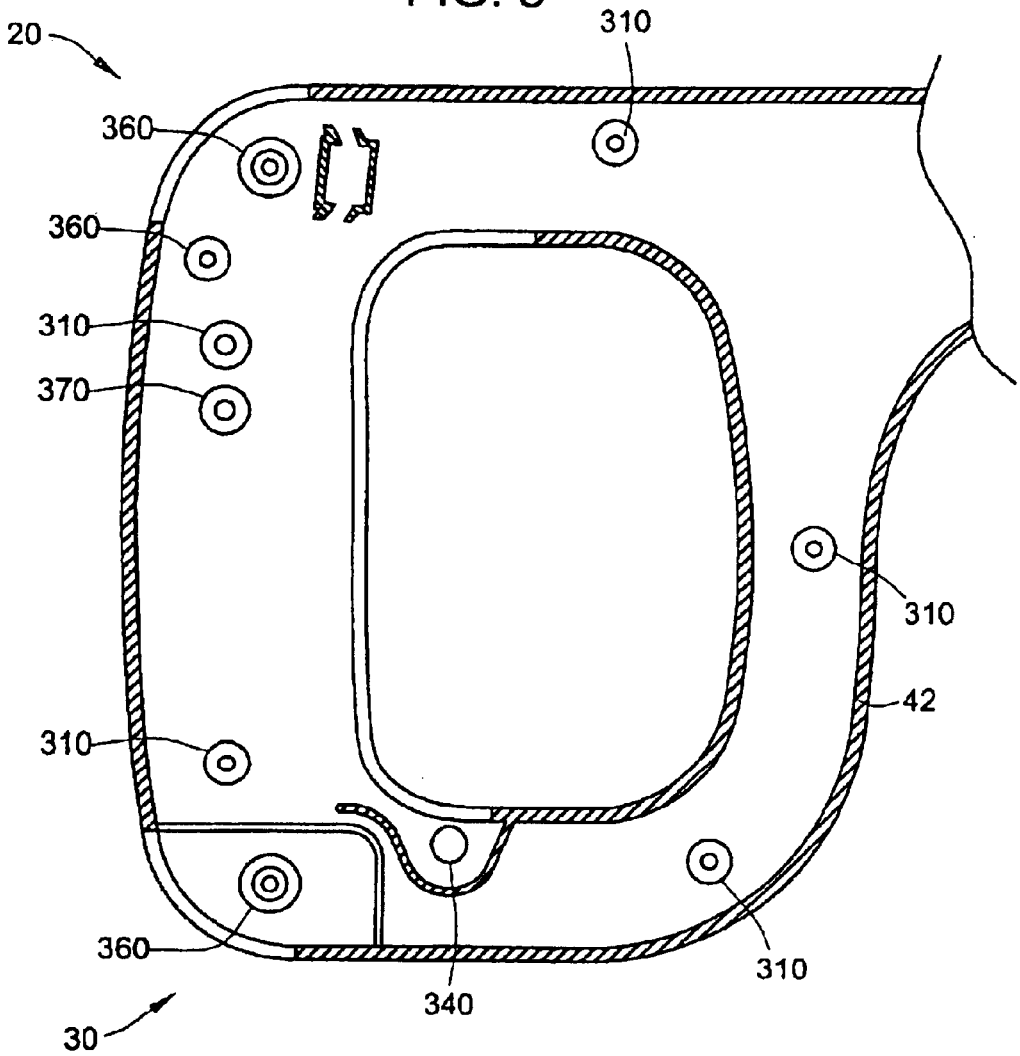
FIG. 3 is a cross-sectional view of an empty handle body for a power tool, in accordance with an embodiment of the present invention.

The handle bottom 42 provides a structural base for mounting of the other parts of the present invention. A cross-sectional view from above of the empty handle bottom 42 is shown in FIG. 3. The cross-section is taken generally along the cross-sectional plane shown as the line I—I in FIG. 2. The empty handle bottom 42 has a plurality of spacers 310 for connecting the handle bottom 42 with the handle top 44. In addition there are pivot mounts 360 for the left side 20 and right side 30 of the handle bottom 42. The contact mounts 370 are provided for mounting of the switch box (540 in FIGS. 5–8). The switch lever pivot mount 340 provides a pivotal mount for the switch lever (410 in FIGS. 4–8). The spring mount 300 provides a slot for housing the spring (460 in FIG. 4). In an embodiment, the handle bottom 42 itself is molded plastic.

Advantageously, two separate movements are required for activation of a tool incorporating the ambidextrous switch lockout system. FIG. 4 illustrates how, in an embodiment, the blocking mechanism 400 of the present invention requires two separate movements for activation. Basic structures of the blocking mechanism 400 are the switch lever 410 and barrier 405. According to an embodiment of the present invention, the barrier 405 blocks the switch lever 410 in a blocking position, as shown in FIG. 4A, and allows for the switch lever 410 to be actuated when it is moved either rightwardly (as in FIG. 4B) or leftwardly (as in FIG. 4C) away from the blocking position in FIG. 4A.

Figure 4A:
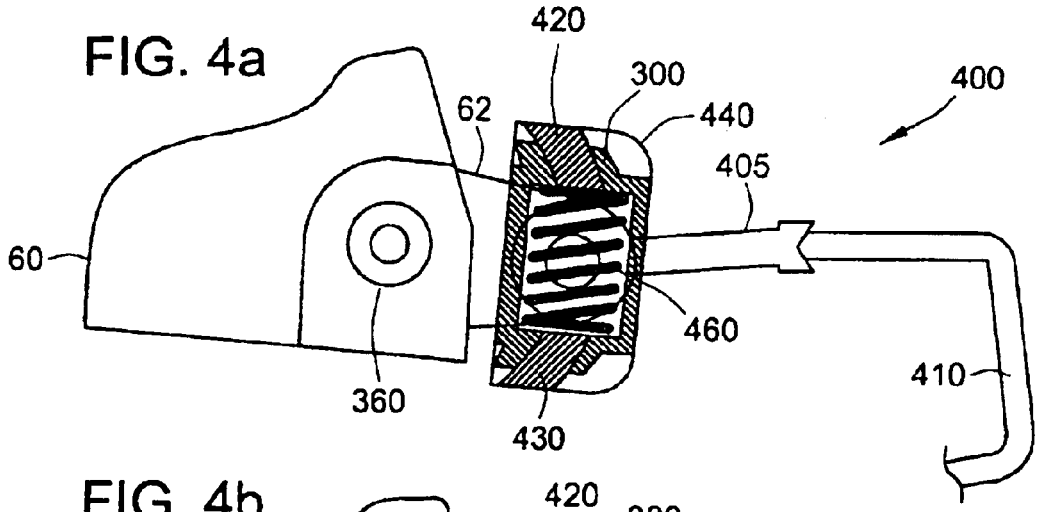
FIG. 4*a* is a cross-sectional view of a left lockout button and a barrier in a blocking position, in accordance with an embodiment of the present invention.
Figure 4B:
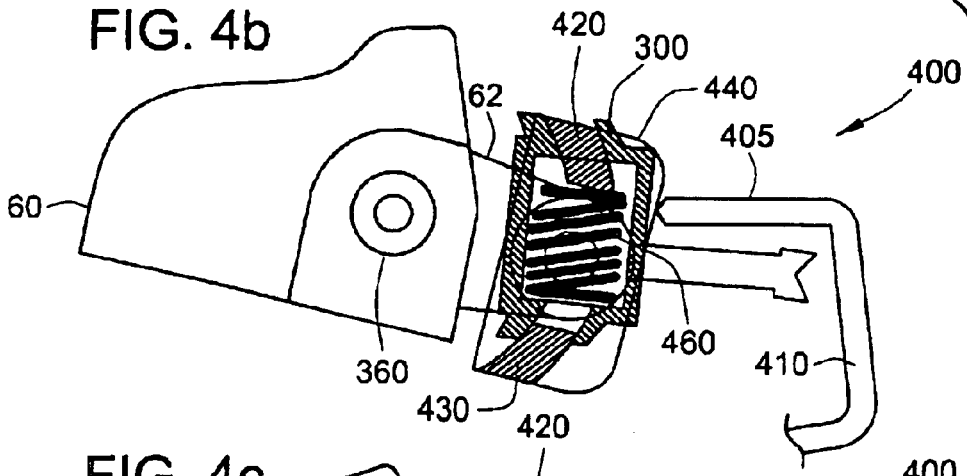
FIG. 4*b* is a cross-sectional view of a left lockout button and a barrier moved rightwardly away from a blocking position, in accordance with an embodiment of the present invention.
Figure 4C:
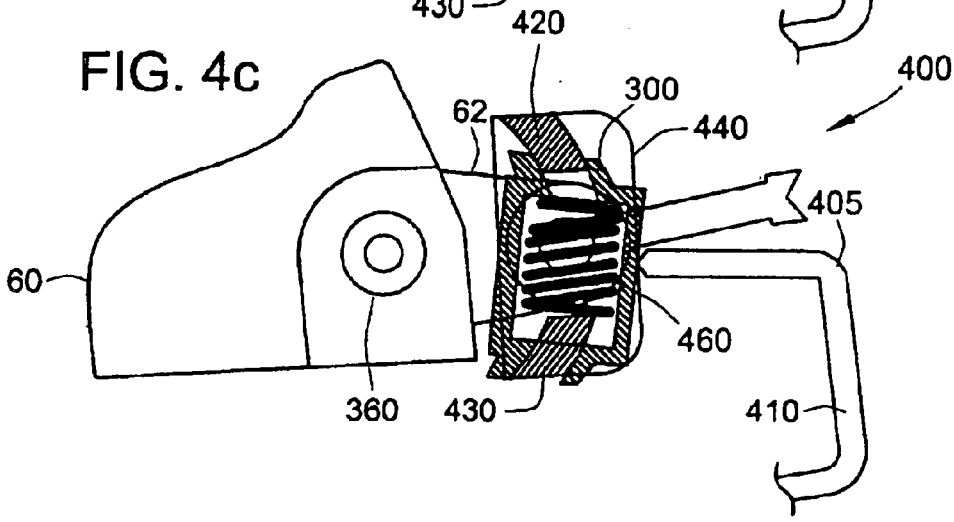
FIG. 4*c* is a cross-sectional view of a left lockout button and a barrier moved leftwardly away from a blocking position, in accordance with an embodiment of the present invention.

Referring to FIG. 4A, there is shown the barrier 405 in a blocking position. Note that the end of the barrier 405 nearest the switch lever 410 is shaped with a surface complementary to that of the end of the switch lever 410 nearest the barrier 405. The respective surfaces are shaped so as to maximize contact when the barrier 405 is in the blocking position. In an embodiment, the complementary surface of the barrier 405 is generally inverted conical, and the switch 410 is generally conical where the two surfaces are in contact in the blocking position.

The barrier 405 is fixed to the left lockout button 60 by a left joining piece 62. Also connected to the left joining piece 62 is a finger mount 440, to which a left finger 420 and a right finger 430 are mounted. The fingers 420 and 430 extend outwardly from the finger mount 440 to contact the spring 460. The finger 420 effectively compresses the spring 460 when the barrier 405 is moved rightwardly, as in FIG. 4B. The finger 430 effectively compresses the spring 460 when the barrier 405 is moved leftwardly, as in FIG. 4C.

The left lockout button 60 is movably mounted to the handle body 40 at the pivot mount 360. A portion of the left lockout button extends toward the left side on the page in FIG. 4; this portion is also called a protrusion since the portion protrudes from the left side 20 of the handle body 40 (see FIG. 1). Pressing of the protrusion by the thumb of a right hand of a user results in a pivoting movement of the left lockout button 60, left joining piece 62, and barrier 405. In the pivoting movement initiated by pressing of the protrusion of the left lockout button 60, the left lockout button 60 moves rightwardly while the barrier 405 moves leftwardly, eventually resulting in the position shown in FIG. 4C. When the right lockout button 70 (not shown in FIG. 4) is pressed, an operable link between the right lockout button 70 and the left lockout button 60 results in a second pivoting movement of the left lockout button 60. In the pivoting movement initiated by the pressing of the right lockout button 70, the left lockout button 60 moves leftwardly while the barrier 405 moves rightwardly, eventually resulting in the position shown in FIG. 4B. As shown by FIGS. 4B and 4C, the switch lever 410 is able to move with an inward movement when the barrier 405 has been moved away (either leftwardly or rightwardly) from the blocking position shown in FIG. 4A. However, when the barrier 405 is moved only slightly, the complementary surfaces of the barrier 405 and the switch lever 410 bias the blocking mechanism 400 back toward the position shown in FIG. 4A.

Also shown in FIG. 4 is the mechanical coupling between the spring 460 and the barrier 405. As shown in FIG. 4B, when the barrier 405 is moved rightwardly, the spring 460 is compressed by the left finger 420 of the finger mount 440. When the barrier 405 is moved leftwardly, as in FIG. 4C, the spring 460 is compressed by the right finger 420 of the finger mount 440. In each case, the energy stored in the spring with movement of the barrier 405 biases the barrier 405 back toward the blocking position (shown in FIG. 4A), wherein the spring is at equilibrium (but not necessarily uncompressed, depending on the size of the spring mount 300). The spring 460 is also called a "centering spring" because the spring 460 biases the barrier 405 toward the blocking position regardless of whether the barrier 405 has been moved rightwardly (as in FIG. 4B) or leftwardly (as in FIG. 4C).

Figure 5:
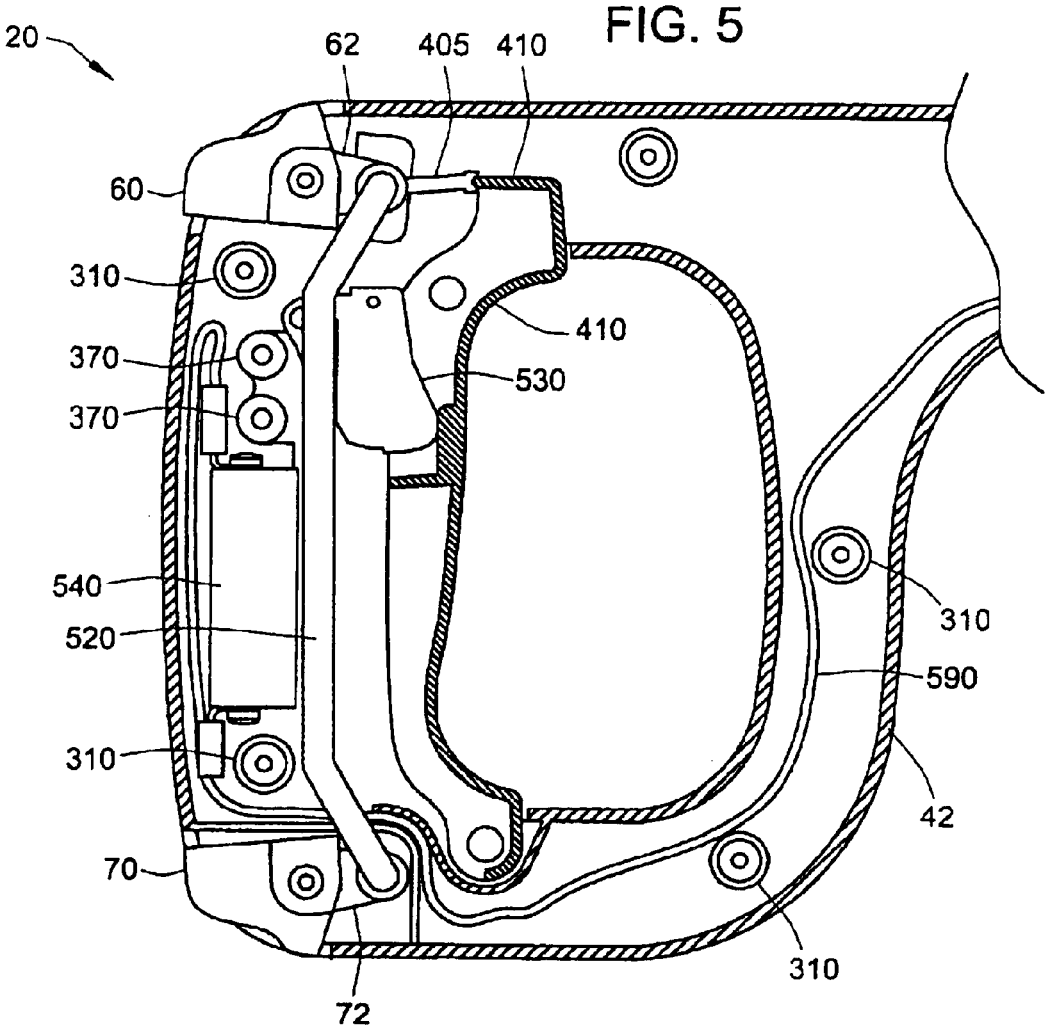
FIG. 5 is a cross-sectional view of an ambidextrous lockout switch, with a barrier in a blocking position, in accordance with an embodiment of the present invention.

In an embodiment, the parts of the invention shown in FIG. 4 fit together with an empty handle body as shown in FIG. 5. A cross-sectional view of the complete handle body 40 taken generally along the line I—I (from FIG. 2) is provided in FIG. 5. In particular, FIG. 5 provides a more complete view of the switch lever 410, only the left portion of which is visible in FIG. 4. As is apparent from the embodiment shown in FIG. 5, the switch lever 410 extends along most of the length of the handle body 40. When the barrier 405 is away from the blocking position, the switch lever may be actuated by an inward, squeezing movement of the fingers of either a left hand or a right hand. As the switch lever 410 is squeezed inwardly, the contact 530 is pivoted into an activated position, powering the tool for which the ambidextrous lockout switch 10 is used. The switch lever 410 pivots around the switch lever mount 340.

In FIG. 5, the barrier 405 is in the blocking position (compare with the close up of the blocking mechanism 400 in FIG. 4A). The left lockout button 60, left joining piece 62, finger mount 440, and barrier 405 all appear as in FIG. 4. However, a linkage 520 is shown in FIG. 5. The linkage 520 operably links the left lockout button 60 to the right lockout button 70 by mechanically coupling the left joining piece 62 to the right joining piece 72 so that a pivotal movement of either the left lockout button 60 or the right lockout button 70 will result in a pivotal movement of both.

Pressing of the right lockout button 70 results in pivoting of the right lockout button 70 and the right joining piece 72 around the pivot mount 360, in substantially the same way as the pressing of the left lockout button 60 results in pivoting of the left lockout button 60 and the left joining piece 62 around the pivot mount 360 near the left side of the handle 10. Because the pivot mount 360 is between the respective lockout buttons and their corresponding joining piece, pivoting of a lockout button in one direction results in a pivoting of the respective joining piece in the opposite direction.

Figure 6:
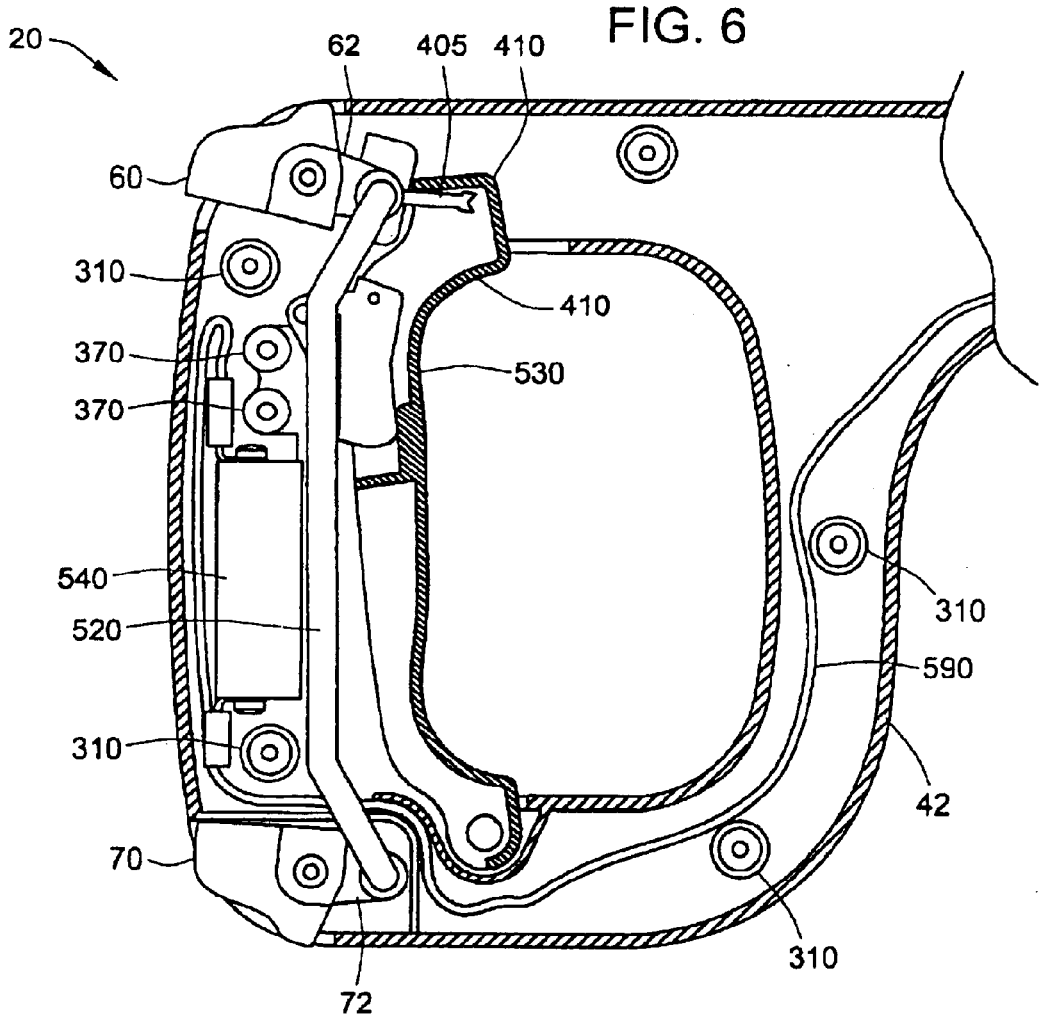
FIG. 6 is a cross-sectional view of an ambidextrous lockout switch, with a barrier moved rightwardly, away from a blocking position, in accordance with an embodiment of the present invention.

FIG. 6 shows an embodiment of the ambidextrous switch lockout system in which the right lockout button 70 has been pressed by the thumb of a left hand. Pressing of the right lockout button 70 with the thumb of a left hand results in leftward pivoting of the right lockout button 70 and rightward pivoting of the right joining piece 72. As the right joining piece 72 pivots rightwardly, the linkage 520 is shifted rightwardly along with the right joining piece 72, and the left joining piece 62, being hingedly connected to the linkage 520 is also shifted rightwardly. The barrier 405, being fixed to the left joining piece 62, is thus also shifted rightwardly, so that the barrier 405 is finally moved from the blocking position and the switch lever 410 is inwardly movable (and has already been moved inwardly in FIG. 6), pivoting the contact 530 as it moves inwardly, and activating a tool for which the ambidextrous lockout switch 10 is used.

FIG. 4B is simply a cross-sectional view of the blocking mechanism in the position shown in FIG. 6. Referring to FIG. 4B, there is shown how the barrier 405 is biased back towards the blocking position (shown in FIGS. 4A and 5). Once the barrier 405 has been pivoted rightwardly, the spring 460 compresses. When the switch lever is released, the contact 530, which, in an embodiment, also contains a contact spring, pushes the switch lever 410 back, and the spring 460 then pushes the barrier 405 back into the blocking position.

Figure 7:
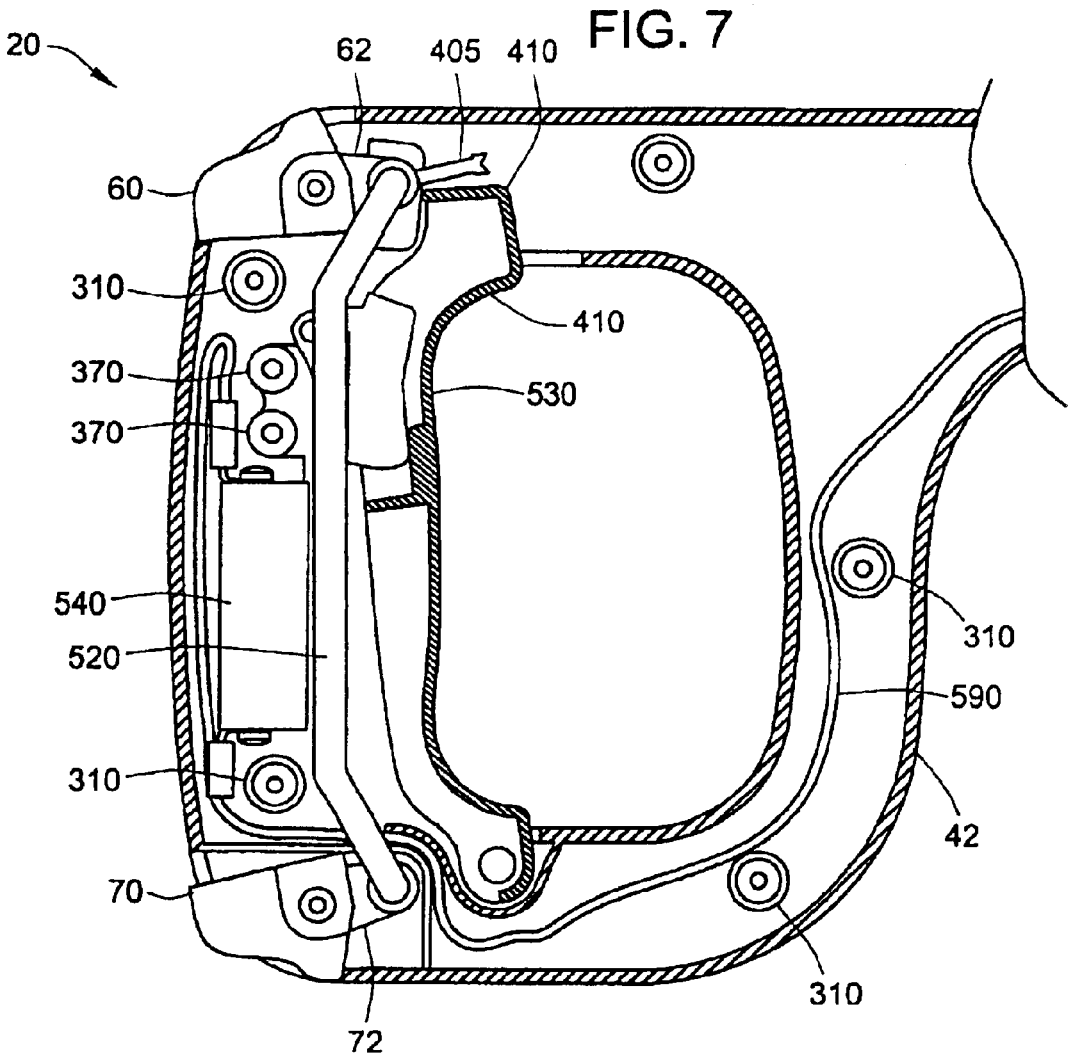
FIG. 7 is a cross-section view of an ambidextrous lockout switch, with a barrier moved leftwardly, away from a blocking position, in accordance with an embodiment of the present invention.

The ambidextrous lockout switch 10 shown in FIG. 7 is an embodiment in which the left lockout button 60 has been pressed by the thumb of a right hand, pivoting the barrier 405 leftwardly away from the blocking position. The switch lever 410 is then free to be moved inwardly, pushing the contact 530 and activating a tool with which the ambidextrous lockout switch 10 is used.

Figure 8:
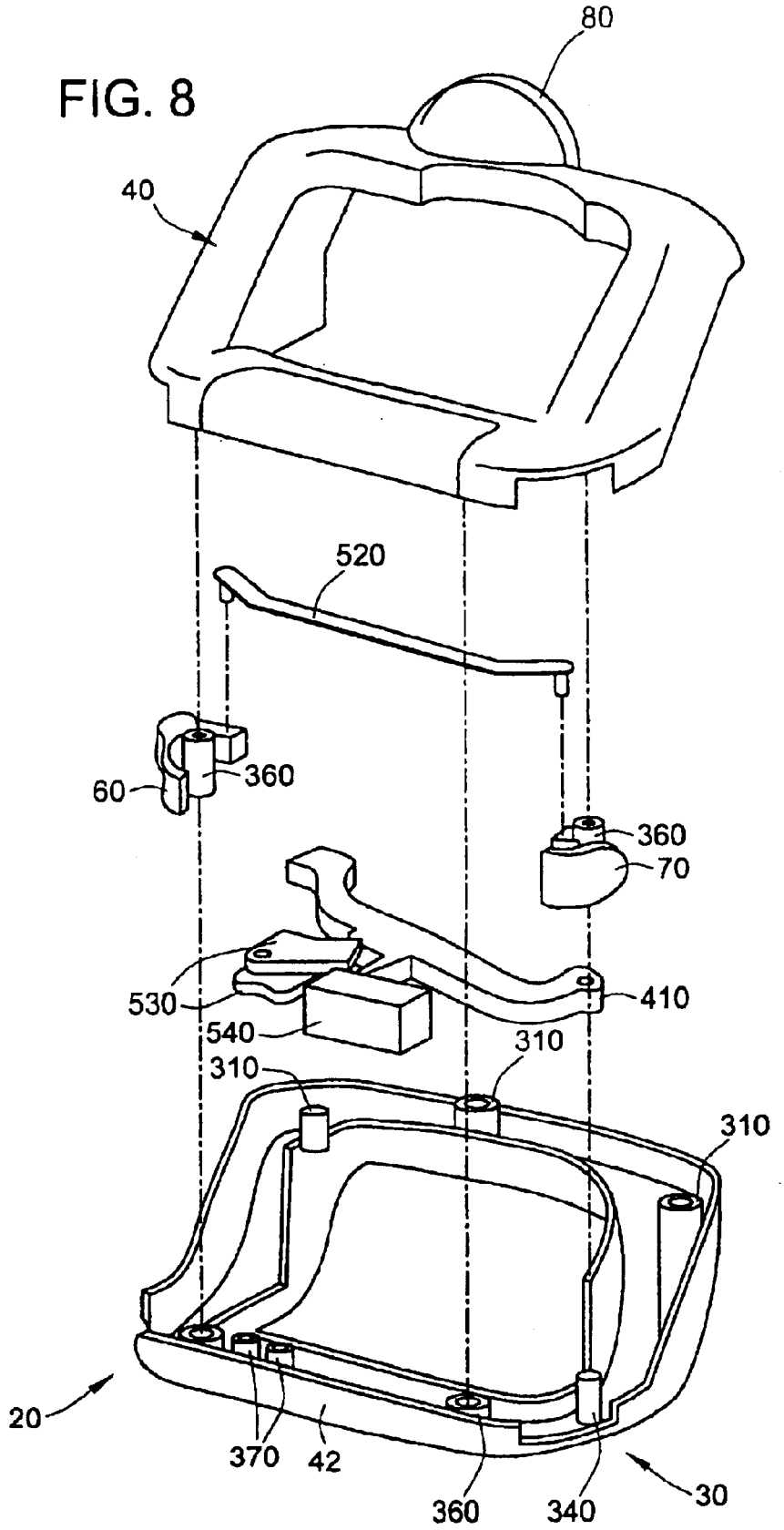
FIG. 8 is an exploded view of an ambidextrous lockout switch, in accordance with an embodiment of the present invention.

A three-dimensional exploded view of the ambidextrous lockout switch system 10 is shown in FIG. 8. The handle body 40 includes a handle bottom 42 and handle top 44. The switch lever 410 is hingedly connected to the handle bottom 42 at the switch lever pivot mount 340. The contact 530 includes, in an embodiment, two layers, and is pivotally connected to the handle bottom 42 by the contact mounts 370. The contact 530 is mounted to the handle bottom 42 near the switch box 540 (also shown in FIGS. 5–7), The switch box 540 has power and control cables (shown in FIGS. 5–7) for connecting with a power tool through the collar mount 80. The linkage 520 operably links the left lockout button 60 and the right lockout button 70, which are mounted to the pivot mounts 360 on the left side 20 and the right side 30 of the handle bottom 42.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An ambidextrous lockout switch, comprising:

a handle body including a first side and a second side;

a switch mounted to the handle body and extending outwardly therefrom, the switch being actuatable by an activating movement;

a first lockout button pivotably mounted to the first side of the handle body;

a barrier fixed to the first lockout button, the barrier being movable from a blocking position in which the activating movement of the switch is blocked by the barrier, wherein pivotal movement of the first lockout button is operable to move the barrier out of the blocking position;

a second lockout button pivotably mounted to the second side of the handle body, the second lockout button adapted for moving the barrier out of the blocking position, the second lockout button being pivotably movable and including a linkage operably linking the first lockout button and the second lockout button; and a spring mounted inside the handle body and mechanically coupled to the barrier, the spring biasing the barrier toward the blocking position.

2. The ambidextrous lockout switch of claim 1, wherein the barrier and the switch have complementary surfaces shaped to maximize surface contact between the barrier and the switch when the barrier is in the blocking position.

3. The ambidextrous lockout switch of claim 1, wherein the barrier is movable away from the blocking position by pivoting of the second lockout button, the pivoting of the second lockout button being operably linked to the pivoting of the first lockout button.

4. The ambidextrous lockout switch of claim 1, wherein at least one finger is fixed to the first lockout button, the at least one finger extending outwardly for contacting the spring, and effective for compressing the spring when the barrier is moved away from the blocking position, the spring being mechanically coupled to the barrier through the at least one finger and the first lockout button.

5. An ambidextrous switch lockout system for use in a handle body with a first side and a second side, the system comprising:

a switch mounted to the handle body and extending outwardly therefrom, the switch generally being actuatable by an activating movement;

a first lockout button pivotably mounted to the first side of the handle body, the first lockout button including:

a protrusion from the first side of the handle body, at least one finger extending form the first lockout button;

a barrier adapted to prevent actuation of the switch by the activating movement when the barrier is in a blocking position, the barrier being movable from the blocking position by pressing of the protrusion from the first side of the handle body;

a second lockout button pivotably mounted to the second side of the handle body, the second lockout button including a protrusion from the second side of the handle body, the second lockout button including a linkage operably linking the first lockout button and the second lockout button; and a spring mounted inside the handle body and contacting the at least one finger, the spring biasing the barrier toward the blocking position and being deflected when the barrier is moved away from the blocking position.

6. The ambidextrous lockout switch of claim 5, wherein the barrier and the switch have complementary surfaces shaped to maximize surface contact between the barrier and the switch when the barrier is in the blocking position.

7. The ambidextrous switch lockout system of claim 5, wherein the barrier is movable away from the blocking position by pivoting of the second lockout button, the pivoting of the second lockout button being operably linked to the pivoting of the first lockout button.

8. The ambidextrous switch lockout system of claim 5, wherein pressing the protrusion from the first side of the handle body pivots the first lockout button in a first direction away from a starting angle.

9. The ambidextrous switch lockout system of claim 8, wherein the barrier prevents the activating movement of the switch when the first lockout button is within a first angle in the first direction away from the starting angle and is also within a second angle in a second direction away from the starting angle.

10. The ambidextrous switch lockout system of claim 9, wherein the spring generally restores the first lockout button to the starting angle.

11. The ambidextrous switch lockout system of claim 10, wherein pressing the protrusion from the second side of the handle body pivots the second lockout button in the second direction away from the starting angle, the first lockout button, being operably linked to the second lockout button, in turn pivots also in the second direction away from the starting angle.

12. The ambidextrous switch lockout system of claim 11, wherein the barrier of the first lockout button moves beyond the second angle in the second direction when a linkage between the first lockout button and the second lockout button is pulled by pressing of the protrusion of the second lockout button.

13. An ambidextrous switch lockout system for use in a handle body, the system comprising:

a switch mounted to the handle body and extending outwardly therefrom, the switch generally being actuatable by an activating movement;

a means for blocking the activating movement of the switch when the means for blocking is in a blocking position;

a means for biasing the means for blocking toward the blocking position; and at least two means for selectively moving the means for blocking away from the blocking position in order to allow the activating movement of the switch, at least one of the at least two means having at least one finger extending outwardly toward the means for biasing, the at least one finger adapted for contacting the means for biasing.

14. The ambidextrous switch lockout system of claim 13, wherein the at least two means are a first lockout button and a second lockout button, the first lockout button and the second lockout button being operably linked.

15. The ambidextrous switch lockout system of claim 13, wherein the operable link between the first lockout button and the second lockout button is a linkage.

16. The ambidextrous switch lockout system of claim 15, wherein first lockout button is pivotably mounted to a first side of the handle body and the second lockout button is pivotably mounted to a second side of the handle body.

17. The ambidextrous switch lockout system of claim 16, wherein the means for blocking is fixed to the first lockout button, the means for blocking being movable from the blocking position by pressing of the first lockout button.

18. The ambidextrous switch lockout system of claim 17, wherein the means for blocking is movable from the blocking position by pressing of the second lockout button, the movement of the second lockout button being operably linked to the first lockout button through the linkage.

19. The ambidextrous switch lockout system of claim 13, wherein the means for biasing is a spring mounted inside the handle body and mechanically coupled to the at least two means for selectively moving.

* * * * *